United States Patent [19]

Kapolnek et al.

[11] Patent Number: 5,010,951

[45] Date of Patent: Apr. 30, 1991

[54] GRADED-GROOVE HEAT PIPE

[75] Inventors: Michael R. Kapolnek, Sunnyvale; Alexander R. Feild, Mt. View; Robert T. Hartle, Cupertino; Hillard R. Holmes, Menlo Park, all of Calif.

[73] Assignee: Lockhead Missiels & Space Company, Inc., Sunnyvale, Calif.

[21] Appl. No.: 389,238

[22] Filed: Aug. 3, 1989

[51] Int. Cl.[5] ..... F28D 15/02

[52] U.S. Cl. ..... 165/104.26; 29/890.032; 122/366

[58] Field of Search ..... 165/104.26; 29/890.032; 122/366

[56] References Cited

U.S. PATENT DOCUMENTS 3,537,514 11/1970 Levedahl ..... 165/104.26

4,116,266 9/1978 Sawata ..... 165/104.26

*Primary Examiner*—Albert W. Davis, Jr.

*Attorney, Agent, or Firm*—John J. Morrissey

[57] ABSTRACT

A heat pipe and chemical etching technique is described for providing longitudinally extending capillary grooves of variable cross-sectional dimension on the interior surface of the heat pipe.

4 Claims, 5 Drawing Sheets

TIME 1

TIME 2

ETCHANT
$H_2O$

GRADED-GROOVE HEAT PIPE

TECHNICAL FIELD

This invention pertains generally to heat pipe technology, and more particularly to the formation of longitudinally extending capillary grooves of variable cross-sectional dimension on the interior surface of a heat pipe.

BACKGROUND ART

Longitudinally extending capillary grooves on the interior surface of a heat pipe conventionally have a uniform cross-sectional dimension along the length of the heat pipe. Flow resistance in a capillary groove decreases with increasing cross-sectional area of the groove. However, capillary pressure head from one end of the capillary groove to the other end thereof also decreases with increasing cross-sectional area of the groove. In general, it is desirable for flow resistance to be as low as possible, and for capillary pressure head to be as high as possible in a capillary groove. It has been conventional practice in heat pipe technology to provide a substantially constant cross-sectional dimension (i.e., a substantially constant cross-sectional area) for longitudinally extending capillary grooves on the interior surface of a heat pipe for the entire length of the heat pipe, where the value selected for the constant cross-sectional dimension of the capillary grooves is a trade-off that provides an acceptable flow resistance as well as an acceptable capillary pressure head for the particular application.

SUMMARY OF THE INVENTION

It is an object of the present invention to provide a technique for optimizing the cross-sectional area of a longitudinally extending capillary groove on the interior surface of a heat pipe at any location along the length of the heat pipe.

In accordance with the present invention, longitudinally extending capillary grooves are formed on the interior surface of a heat pipe by a chemical etching technique that produces a variable cross-sectional dimension along the length of the heat pipe.

BEST MODE OF CARRYING OUT THE INVENTION

A heat pipe 10 according to the present invention typically comprises a generally cylindrical hollow member formed integrally from a single piece of metal by a conventional pipe-forming process such as by extrusion through a die, and a generally planar flange member configured in accordance with requirements of a particular application so that one end thereof can be exposed to a heat source and the other end thereof can be exposed to a heat sink. The flange member is secured in good heat-conducting contact with the hollow cylindrical member, or preferably is formed integrally with the hollow cylindrical member. In other embodiments of the invention, there is no flange member, and heat transfer occurs directly through a wall portion of the hollow cylindrical member.

Figure 1:
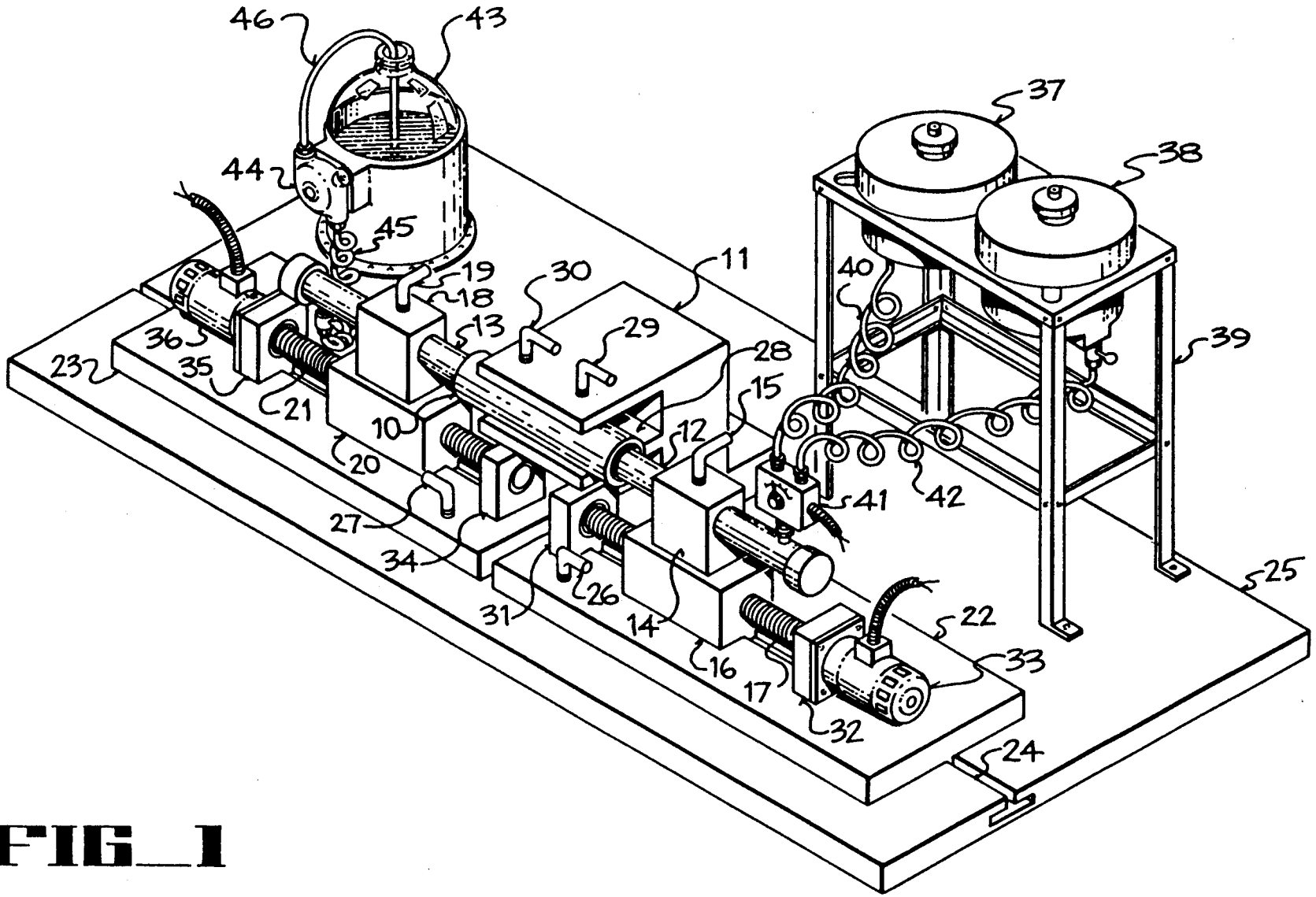
FIG. 1 is a perspective view of a chemical etching apparatus for forming longitudinally extending capillary grooves of graded cross-sectional dimension on the interior surface of a heat pipe in accordance with the present invention.

As shown in FIG. 1, the heat pipe 10 is secured in a jig 11 in readiness for the formation of longitudinally extending capillary grooves of graded cross-sectional dimension on the interior surface of the hollow cylindrical member thereof. Before the heat pipe 10 was placed in the jig 11, longitudinally extending capillary grooves of generally constant cross-sectional dimension had previously been forced on the internal surface of the hollow cylindrical member thereof by a conventional technique (e.g., reaming, extruding or swaging). The technique of the present invention as illustrated in FIG. 1 enables the initially constant cross-sectional dimension of the capillary grooves to be varied along the length of the heat pipe 10 in accordance with a predetermined design, whereby a desired cross-sectional profile for the capillary grooves is achieved.

The cross-sectional profile of the longitudinally extending capillary grooves formed on the interior surface of the hollow cylindrical member of the heat pipe 10 by the technique illustrated in FIG. 1 is designed to optimize the performance of the heat pipe 10 for a particular application. Heat transfer and heat transport characteristics of the heat pipe 10 can be varied along the length thereof according to the requirements of the particular application. As shown in FIG. 1, the heat pipe 10 is secured in the jig 11 so that an etchant supply plunger 12 can be inserted coaxially into a first end of the hollow cylindrical member thereof, and so that an etchant removal plunger 13 can be inserted coaxially into a second end of the hollow cylindrical member thereof. The etchant supply plunger 12 is carried by a mounting device 14, and can be fixedly secured thereto by a suitable fastening means (as by a hook-head screw 15). The mounting device 14 is permanently secured to a block 16 that is movable by means of a worm gear 17 extending parallel to the etchant supply plunger 12. Similarly, the etchant removal plunger 13 is carried by a mounting device 18, and can be fixedly secured thereto by a suitable fastening means (as by a hook-head screw 19). The mounting device 18 is permanently secured to a block 20 that is movable by means of a worm gear 21 extending parallel to the etchant removal plunger 13.

The block 16 has a tongue portion that slides in a slot on the surface of a base plate 22 as the worm gear 17 rotates. Thus, the mounting device 14 secured to the block 16 moves the etchant supply plunger 12 into or out of the first end of the heat pipe 10 in response to the rotation of the worm gear 17. Similarly, the block 20 has a tongue portion that slides in a slot on the surface of a base plate 23 as the worm gear 21 rotates. Thus, the mounting device 18 secured to the block 20 moves the etchant removal plunger 13 into or out of the second end of the heat pipe 10 in response to the rotation of the worm gear 21. The base plates 22 and 23 have tongue portions that are slidable in a slot 24 on a platform 25, and can be secured in fixed positions on the platform 25 by hook-head screws 26 and 27, respectively, when the heat pipe 10 is properly positioned in the jig 11 so that etchant can be supplied to and removed from the interior of the hollow cylindrical member thereof to form the graded capillary grooves thereon. The jig 11 is permanently secured to the platform 25, and comprises a ledge portion 28 upon which the heat pipe 10 is positioned. The heat pipe 10 is securable in position on the ledge 28 by means of hook-head screws 29 and 30.

In the apparatus shown in FIG. 1, the worm gear 17 (to which the slidable block 16 is attached) is supported by end blocks 31 and 32, which receive respective ends of the worm gear 17 in screw-threaded sockets that permit axial rotation of the worm gear 17. An electric motor 33 mounted on the base plate 22 is used to effect rotation of the worm gear 17 automatically according to a predetermined program for exposing different portions of the interior of the heat pipe 10 to etchant for different lengths of time. The drive shaft of the motor 33 is coupled to the end of the worm gear 17 supported by the end block 32. Similarly, the worm gear 21 (to which the slidable block 20 is attached) is supported by end blocks 34 and 35, which receive respective ends of the worm gear 21 in screw-threaded sockets that permit axial rotation of the worm gear 21. Rotation of the worm gear 21 is effected automatically by means of an electric motor 36 mounted on the base plate 23. The drive shaft of the motor 36 is coupled to the end of the worm gear 21 supported by the end block 35.

An etchant container 37 and a rinse container 38 are supported on a stand 39, which is permanently secured to the platform 25. The etchant contained within the container 37 is a liquid solution whose chemical composition depends upon the metal of which the hollow cylindrical portion of the heat pipe 10 is made. For etching capillary grooves on the interior surface of an aluminum heat pipe, an advantageous etchant is a solution of sodium hydroxide. The ring contained within the container 38 could advantageously be water in most circumstances. The containers 37 and 38 are supported by the stand 39 at a height above the plungers 12 and 13, so that etchant and rinse can be delivered to the plunger 12 by gravity. A coiled flow line 40 (preferably made of stainless steel) leads from the container 37 to an electrically operated mixing valve 41, which communicates with a closed end region of the etchant supply plunger 12. Similarly, a coiled flow line 42 (also preferably made of stainless steel) leads from the container 38 to the mixing valve 41.

During the etching process, etchant flows through the etchant supply plunger 12 into the interior of the heat pipe 10, and passes through the interior of the heat pipe 10 into the etchant removal plunger 13. While passing through the interior of the heat pipe 10, the etchant chemically reacts with the interior surface thereof. The capillary channels of uniform cross-sectional dimension previously formed on the interior surface of the heat pipe 10 are exposed to etchant for varying lengths of time along the length of the heat pipe 10 in order to achieve a gradation in the cross-sectional dimension of the capillary grooves along the length of the heat pipe 10. Consequently, the etchant removed from the interior of the heat pipe 10 by the etchant removal plunger 13 (i.e., the "spent" etchant) is chemically different from the etchant supplied to the interior of the heat pipe 10 by the etchant supply plunger 12 (i.e., the "fresh" etchant).

The spent etchant is withdrawn from the etchant removal plunger 13 into a spent etchant container 43, which is permanently secured to the platform 25. As illustrated in FIG. 1, an electrically operated pump 44 mounted on the spent etchant container 43 withdraws spent etchant from the plunger 13 into the container 43. The pump 44 has an inlet that communicates with a closed end region of the etchant removal plunger 13 by means of a coiled flow line 45 (preferably made of stainless steel), and an outlet that communicates with the spent etchant container 43 by means of a tube 46 (also preferably made of stainless steel).

Figures 2, 3, 4:
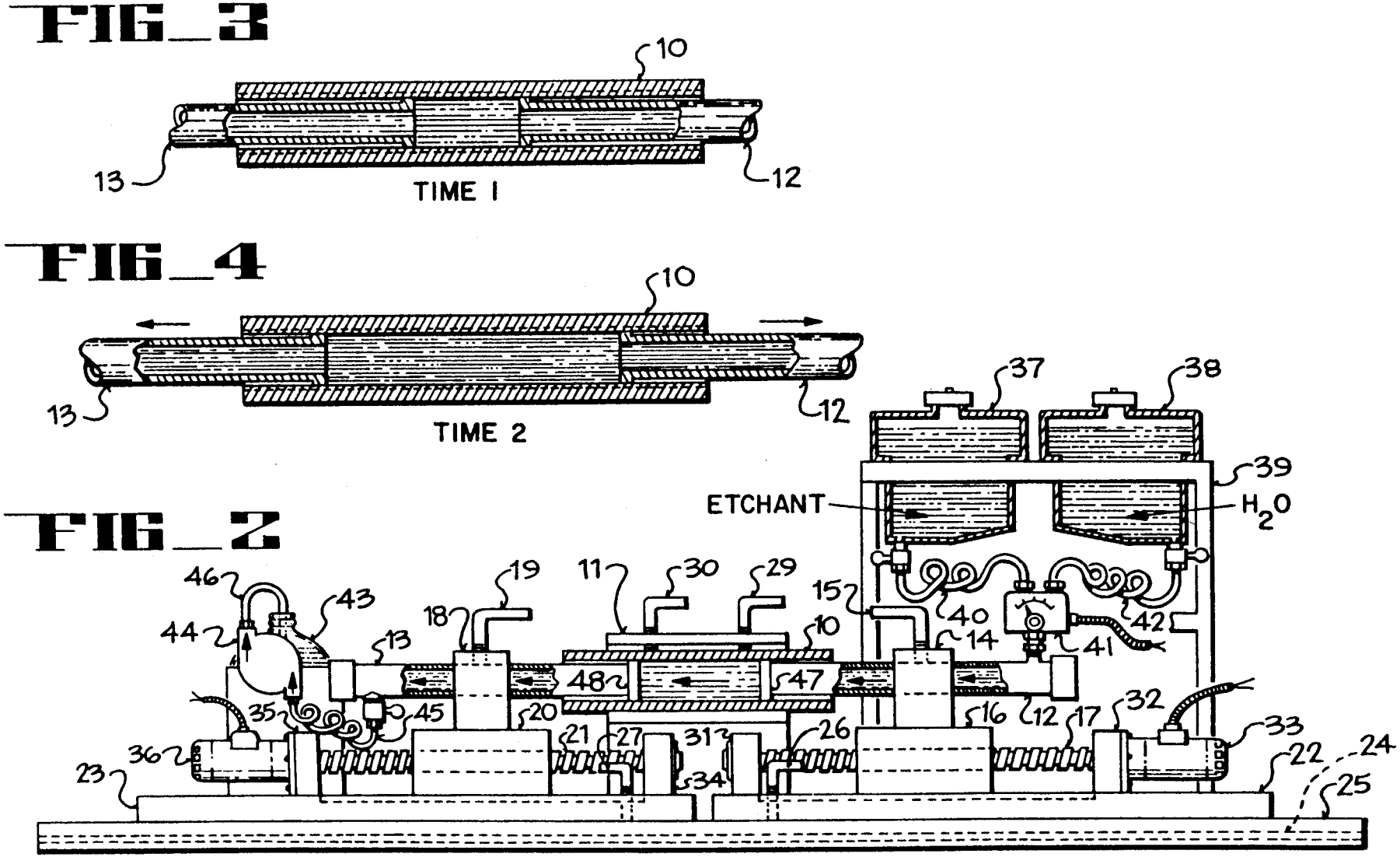
FIG. 2 is an elevation view, partly broken away, of the chemical etching apparatus of FIG. 1.
FIG. 3 is a longitudinal cross-sectional view of a heat pipe mounted on the chemical etching apparatus of FIG. 1, where an etchant supply plunger and an etchant removal plunger of the apparatus are located at respective first positions within the heat pipe.
FIG. 4 is a longitudinal cross-sectional view of a heat pipe mounted on the chemical etching apparatus of FIG. 1, where the etchant supply plunger and the etchant removal plunger are located at respective second positions within the heat pipe.

An elevation view of the apparatus of FIG. 1 is illustrated in FIG. 2 in broken-away detail to indicate the flow of etchant through the interior of the heat pipe 10. Etchant comes into contact only with predetermined portions of the interior of the heat pipe 10, as determined by: (a) the axial extent to which the etchant supply plunger 12 and the etchant removal plunger 13 are inserted into the interior of the heat pipe 10, and (b) the configuration of end plugs secured to the ends of the plungers 12 and 13 that are inserted into the interior of the heat pipe 10. The plungers 12 and 13 can be moved axially within the heat pipe 10, either continuously or discontinuously, according to a program designed to allow etchant to remain in contact according to the predetermined schedule with the capillary grooves of generally constant cross-sectional dimension previously formed on the interior surface of the heat pipe 10. Thus, the initially constant cross-sectional dimension of the capillary grooves along the length of the heat pipe 10 is changed to achieve a graded (or otherwise varying) cross-sectional dimension of the capillary grooves according to the desired cross-sectional profile for the particular application.

As illustrated in FIG. 3, the plungers 12 and 13 are shown in particular positions at an instant in time (designated as "TIME 1") after the etchant has had an opportunity to etch away surface portions of the capillary channels along the length of the heat pipe 10 for corresponding lengths of time determined by the rate of separation of the plungers 12 and 13 from each other. As illustrated in FIG. 4. the plungers 12 and 13 are shown at different positions at a subsequent instant in time (designated as "TIME 2") after the etchant has had an opportunity to etch away larger surface portions of the capillary channels along the length of the heat pipe 10 for corresponding longer lengths of time as the plungers 12 and 13 are separated further apart from each other. Normally, the rate of flow of etchant through the heat pipe 10 is not varied. Preferably, a constant flow of etchant is provided at a sufficient rate to keep etchant in contact with the surface portions of the capillary grooves at all times.

Figures 5, 6, 7, 8:
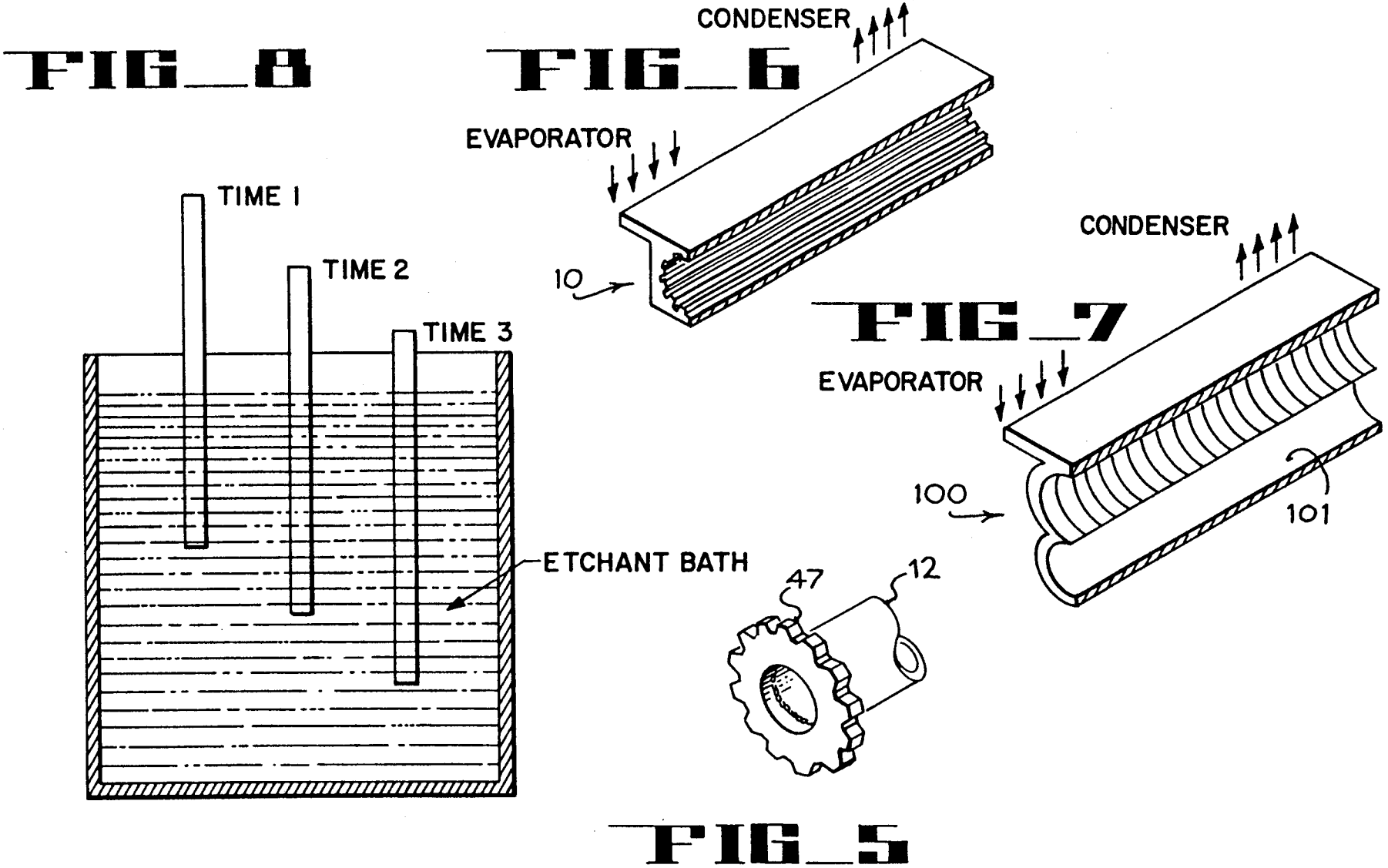
FIG. 5 is a perspective view of an end portion of the etchant supply plunger of the chemical etching apparatus of FIG. 1.
FIG. 6 is a perspective view in longitudinal cross-section of a heat pipe with longitudinally extending capillary grooves of graded cross-sectional dimension in accordance with the present invention.
FIG. 7 is a perspective view in longitudinal cross-section of an arterial heat pipe with an artery of graded cross-sectional dimension in accordance with the present invention.
FIG. 8 is a cross-sectional view of an etchant bath used in an alternative technique according to the present invention for forming longitudinally extending capillary grooves of graded cross-sectional dimension in accordance with the present invention.

In FIG. 5, detailed features of the open end of the plunger 12 (i.e., the end inserted into the interior of the heat pipe 10) are shown. Specifically, an annular plug 47 is fitted over the open end of the plunger 12. The perimeter of the plug 47 is configured to fit matingly within the capillary grooves of initially constant cross-sectional dimension on the interior surface of the heat pipe 10, thereby confining etchant to the region of the interior of the heat pipe 10 downstream of the open end of the plunger 12. As indicated in FIG. 2, a similar plug 48 is fitted over the open end of the plunger 13. The perimeter of the plug 48 is likewise configured to fit matingly within the capillary grooves of initially constant cross-sectional dimension on the interior surface of the heat pipe 10, and confines the etchant to the region of the heat pipe 10 upstream of the open end of the plunger 13.

FIG. 6 is a longitudinal cross-sectional view of the heat pipe 10 showing capillary grooves having a graded cross-sectional dimension on the interior surface thereof. As seen in FIG. 6, the capillary grooves are wider at one end and narrower at the other end of the heat pipe 10. FIG. 7 is a longitudinal cross-sectional view of an arterial heat pipe 100, whose artery 101 can be given a graded cross-sectional dimension by the technique of the present invention. As seen in FIG. 7, the artery 49 has a wider diameter at one end and a narrower diameter at the other end thereof.

It will be recognized that the apparatus shown in FIG. 1 functions to expose different portions of the interior surface of the heat pipe 10 to an etchant for correspondingly different lengths of time. The same function could be achieved by, e.g., lowering the heat pipe 10 vertically into an etchant bath. As illustrated schematically in FIG. 8, the heat pipe 10 is shown after having been lowered into an etchant bath to three successive depths corresponding to three successive points in time designated as "TIME 1", "TIME 2" and "TIME 3".

Figure 9:
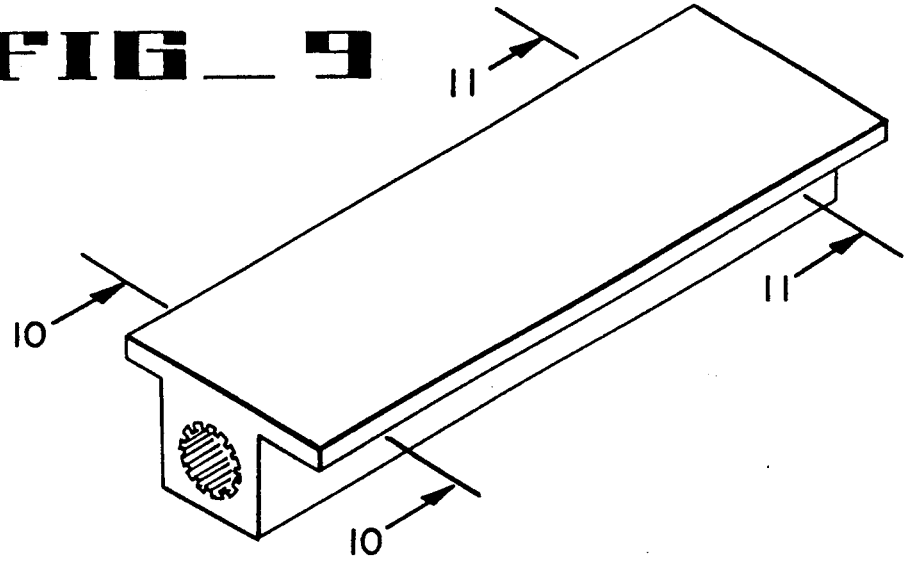
FIG. 9 is a perspective view of a graded-groove heat pipe according to the present invention.
Figure 10:
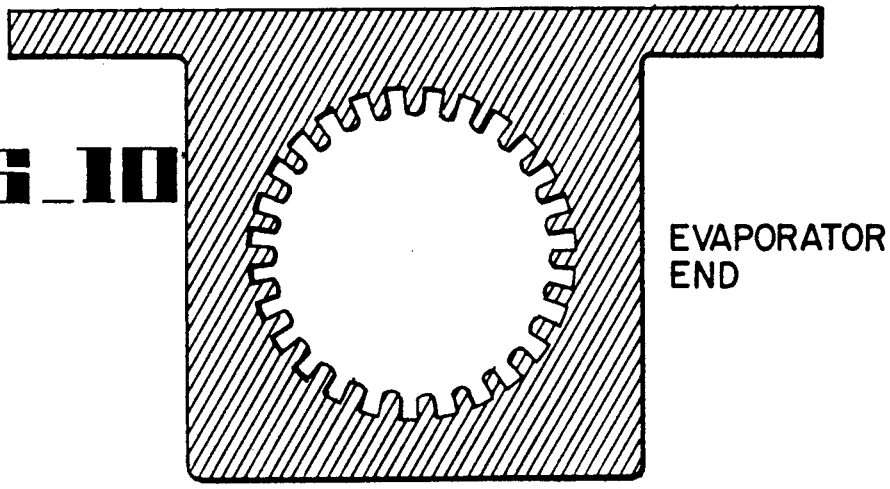
FIG. 10 is a cross-sectional view along line 10—10 of FIG. 9.
Figure 11:
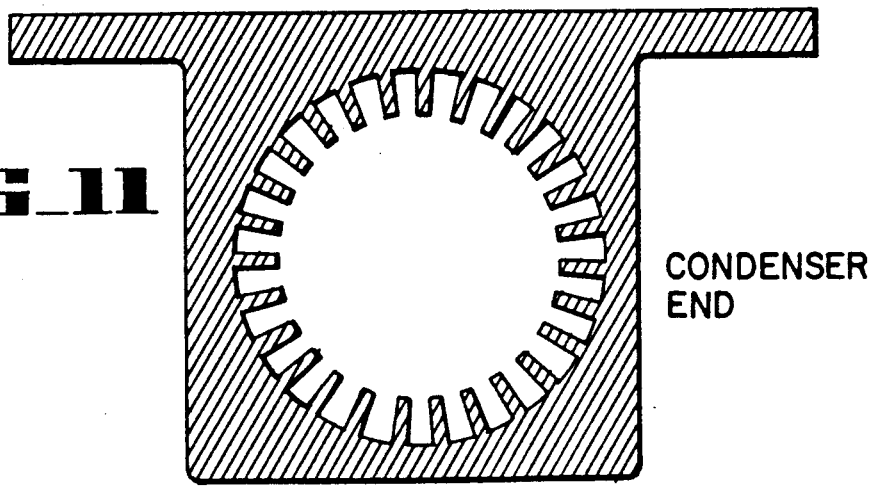
FIG. 11 is a cross-sectional view along line 11—11 of FIG. 9.
Figure 12:
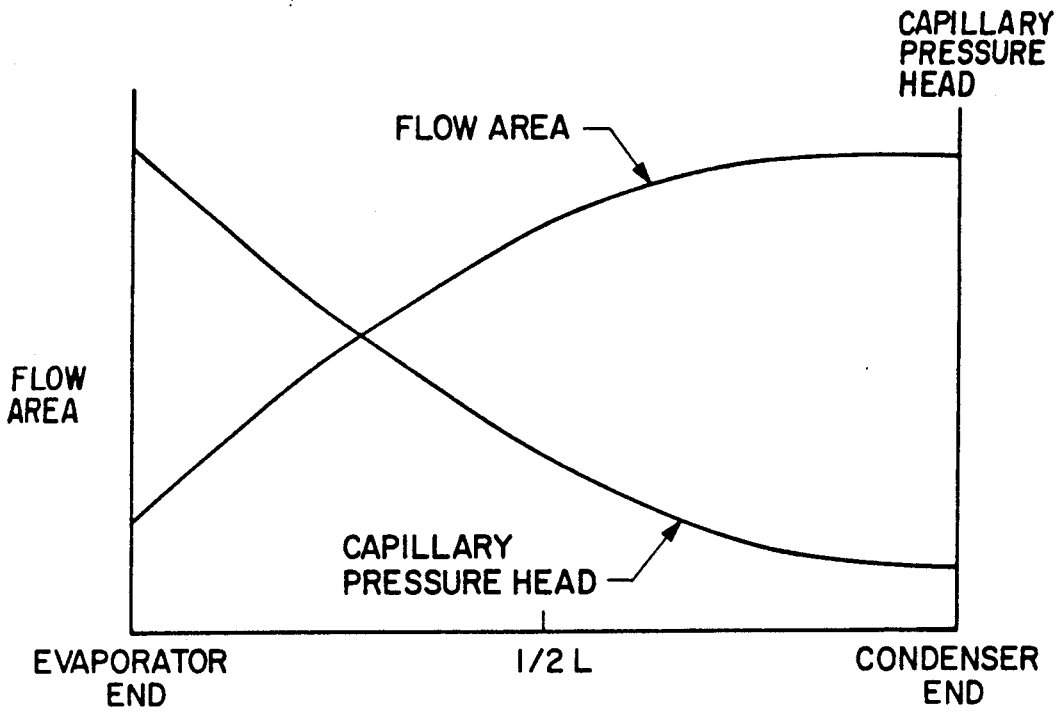
FIG. 12 is a graphical representation of flow area and capillary pressure head plotted as functions of heat pipe length for a graded-groove heat pipe according to the present invention.
Figure 13:
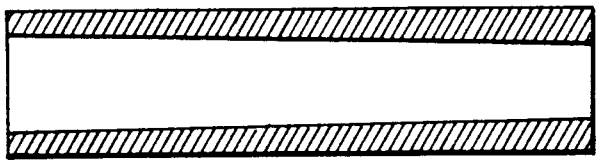
FIGS. 13, 14 and 15 are longitudinal cross-sectional views illustrating selected types of variable capillary grooves that can be formed according to the present invention.
Figure 14:
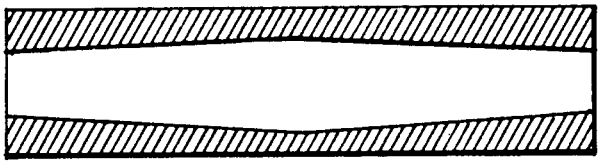
Figure 15:
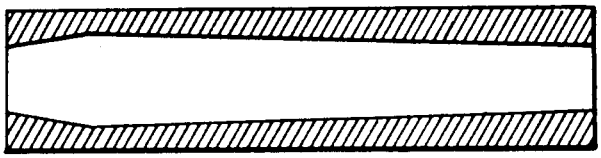

FIG. 9 shows the heat pipe 10 in perspective view. A cross-sectional view at the evaporator end of the heat pipe 10 is shown in FIG. 10, and a cross-sectional view at the condenser end of the heat pipe 10 is shown in FIG. 11. The width of the capillary grooves is seen in FIGS. 10 and 11 to vary from one end of the heat pipe 10 to the other. FIG. 12 is a graphical representation on a single plot of flow area and capillary pressure head as functions of heat pipe length for a typical graded-groove heat pipe according to the present invention. At any axial position along the heat pipe, the flow area and the capillary pressure head can be selected to provide an optimum trade-off for the particular application in which the heat pipe is to be used. FIGS. 13, 14 and 15 illustrate various capillary groove profiles suitable for different applications.

The present invention has been described above in terms of particular embodiments suitable for different applications. Other embodiments suitable for yet other applications would be apparent to practitioners skilled in the art upon perusal of the foregoing specification and accompanying drawing. Therefore, the embodiments described in the specification and drawing are merely illustrative of the invention, which is defined more generally by the following claims and their equivalents.

We claim:

1. A heat pipe comprising a closed hollow structure elongate along an axis, said heat pipe having:

(a) an evaporator domain in which working fluid in liquid phase is evaporated to vapor phase, and (b) a condenser domain to which working fluid in vapor phase is conveyed for condensation to liquid phase, said evaporator domain and said condenser domain being separated from each other along said axis, a capillary groove being provided on an interior surface portion of said heat pipe to transport liquid-phase working fluid by capillary action from said condenser domain to said evaporator domain for evaporation to vapor phase, said capillary groove having a transverse cross-sectional dimension that varies continuously with length of said heat pipe, said transverse cross-sectional dimension having an extreme value at a location between opposite ends of said capillary groove in accordance with a predetermined profile for said capillary groove.

2. The heat pipe of claim 1 having a plurality of capillary grooves on said interior surface portion of said heat pipe for transporting liquid-phase working fluid by capillary action from said condenser domain to said evaporator domain, each of said capillary grooves having a transverse cross-sectional dimension that varies with length of said heat pipe, said transverse cross-sectional dimension having a maximum value at a location between opposite ends for each of said capillary grooves.

3. A heat pipe having longitudinally extending capillary grooves on an interior surface portion thereof, each of said capillary grooves having a transverse cross-sectional dimension that varies continuously with length of said heat pipe, said transverse cross-sectional dimension having an extreme value at a location between opposite ends for each of said capillary grooves in accordance with a predetermined profile, said heat pipe being made by a process comprising the steps of:

(a) forming a plurality of capillary grooves of generally constant initial transverse cross-sectional dimension on said interior surface portion of said heat pipe, and (b) exposing different surface portions of each of said capillary grooves of generally constant initial transverse cross-sectional dimension to a chemical etchant for correspondingly different lengths of time according to a predetermined program so that different surface portions of each capillary groove acquire correspondingly different transverse cross-sectional dimensions in accordance with said profile.

4. The heat pipe of claim 3 wherein said extreme value of said transverse cross-sectional dimension of each of said capillary grooves is a maximum value.

* * * * *